United States Patent [19]

Ferris

[11] Patent Number: 4,884,364

[45] Date of Patent: Dec. 5, 1989

[54] METHOD AND APPARATUS FOR CUT FLOWER STORAGE AND DISPLAY

[76] Inventor: John Ferris, 1506 19th St., Sacramento, Calif. 95814

[21] Appl. No.: 166,993

[22] Filed: Mar. 11, 1988

Related U.S. Application Data

[63] Continuation-in-part of Ser. No. 927,648, Nov. 5, 1986.

[51] Int. Cl.[4] ..... A01G 5/00

[52] U.S. Cl. ..... 47/41.01; 47/79

[58] Field of Search ..... 47/41, 79

[56] References Cited

U.S. PATENT DOCUMENTS

| | | | |
|---|---|---|---|
| 3,452,475 | 7/1969 | Johnson | 47/79 |
| 3,841,023 | 10/1974 | Carlyon | 47/79 |
| 4,042,150 | 8/1977 | Roos | 47/79 X |

FOREIGN PATENT DOCUMENTS

| | | | |
|---|---|---|---|
| 2541075 | 8/1984 | France | 47/41 |

*Primary Examiner*—Robert A. Hafer

*Attorney, Agent, or Firm*—Flehr, Hohbach, Test, Albritton & Herbert

[57] ABSTRACT

A cut flower storage and display assembly is provided wherein a plurality of storage and display containers are mountable in vertical columns on a display rack assembly. A liquid circulation system is disclosed whereby liquid may be continuously or intermittently circulated through the liquid reservoirs of each container in a vertical column. The liquid circulation system may include a filtration system for removal of substantially all harmful microbes from the circulating liquid, and suitable dosages of a floral preservative and an algaecide may be added to the circulating liquid. The liquid circulation and treatment system may also provide circulation of cooled liquid to preserve the fresh appearance and prolong the useful lifetime of cut flowers. The arrangement of storage and display containers in display rack assemblies of the present invention provides efficient, economical use of storage and display space.

17 Claims, 7 Drawing Sheets

METHOD AND APPARATUS FOR CUT FLOWER STORAGE AND DISPLAY

This application is a continuation-in-part of U.S. Patent Application Ser. No. 927,648, filed Nov. 5, 1986.

TECHNICAL FIELD

The present invention relates generally to a method and apparatus for providing efficient and economical storage and display of cut flowers and the like, and for prolonging the useful life of cut flowers during storage and display, particularly at retail outlets. The present invention relates, more specifically, to a liquid circulation and filtration system for use with cut flower storage and display assemblies to substantially eliminate microbial populations in the circulating liquid, thereby prolonging the useful lifetime of cut flowers and preserving their fresh appearance.

BACKGROUND ART

Cut flowers have conventionally been sold in the United States as arrangements. More recently, a trend has developed in this country toward the sale of cut flowers in bunches or by the stem, a practice that has hitherto been more common in European countries. The consumer then arranges such flowers after purchase, or may simply place them in a vase for display.

Cut flowers offered for sale at the retail level at florist shops, specialty markets, grocery markets, and the like, are conventionally stored and displayed in buckets or other containers of liquid. Despite the fact that cut flower storage and displays generally require a relatively large area of floor space and may require refrigeration, the growth rate of cut flower sales in retail outlets such as specialty markets, grocery stores, department stores, and the like, is substantial.

The useful lifetime of cut flowers, that is the period of time during which cut flowers maintain a fresh appearance, is generally limited by the rapid propagation of microorganisms in the liquid and accumulation of microorganisms in the xylem of the cut flowers. Propagation of microbes at the cut of the plant stem effectively blocks transport of water and nutrients to the leaves and blossoms, and results in rapid deterioration in the fresh appearance of the flowers and substantially reduces the useful lifetime of cut flowers.

In addition to the loss of freshness and appearance induced by the rapidly multiplying microbial populations, propagation of algae in the liquid typically results in unpleasant odors, and causes deterioration of the cut flower stems and leaves. It has been estimated that about 15% to about 20% of fresh cut flowers delivered to retail outlets are wasted and disposed of due to the deterioration in their appearance caused by the proliferation of the microbial and algal populations in the water source.

Proper maintenance of cut flowers requires frequent changes of the liquid in the containers in addition to thorough scrubbing of the containers to destroy the microbial and algal populations. To preserve the health and appearance of cut flowers, containers should be thoroughly cleaned and filled with fresh water at least once each day. Proper maintenance of cut flowers is thus a labor intensive operation, since cut flower containers are conventionally relatively small, and emptying, scrubbing, and refilling a plurality of small containers is a time consuming operation which is not susceptible to automation. Consequently, cut flowers are typically not cared for properly, particularly at the retail level, and premature deterioration and loss of freshness reduces their useful lifetime.

Soluble floral preservatives are known in the art, such as FLORALIFE, which may be added to the liquid to prolong the useful lifetime of cut flowers. Soluble algaecides are also known to reduce algal populations. Use of floral preservatives and algaecides in cut flower retail outlets is effective to prolong the useful life of cut flowers, but it is also labor intensive, since each time the liquid is emptied and replaced in each of the containers, proper dosages of floral preservative and algaecide must be added to the container and mixed with the fresh liquid.

Fresh cut flowers are generally stored and displayed for sale in a plurality of individual buckets or containers with water for preserving their freshness. A plurality of containers is generally arranged on the floor of the retail outlet, or on shelves for display and retail sale. This arrangement requires a considerable amount of floor space and is quite limited in terms of creative display possibilities. Floral displays of this type typically have a cramped and uninspiring appearance, in addition to occupying a large amount of expensive floor space.

Fresh cut flowers are typically stored and/or displayed in refrigerated areas to preserve their fresh appearance. Since it is impractical to refrigerate only the liquid in each container, the containers themselves and the cut flowers arranged therein are typically kept in a refrigerated area. This arrangement requires a large amount of floor space in a cooler or other refrigerated area and entails considerable expense.

A variety of structures has been proposed in the prior art for reducing the space required for growing plants. Examples of such structures are shown in the following issued U.S. Pat. Nos. 1,217,239, issued Feb. 27, 1917 to Schwartz; 3,293,798, issued Dec. 27, 1966 to Johnson, Sr.; 3,374,574, issued Mar. 26, 1968 to Haile; 3,447,261, issued Jun. 3, 1969 to Hundt; 3,445,055, issued Jul. 15, 1969 to Chute; 4,123,873, issued Nov. 7, 1978 to Canova; 4,334,387, issued Jun. 15, 1982 to Karpisek; 4,355,485, issued Oct. 26, 1982 to Frank and 4,380,136, issued Apr. 19, 1983 to Karpisek. U.S. Pat. No. 3,452,475, issued Jul. 1, 1969 to Johnson, Sr., teaches a vertically tiered self-irrigated planter including a plurality of vertically stacked trays having peripheral annular troughs containing soil for plants. The trays are provided with annular water chambers arranged inwardly of the soil troughs and in communication with the soil troughs at their lower end portions. The vertically stacked trays are provided with overflow apertures to allow water to drip from upper to successively lower trays. Water reservoirs are also provided with water level control and water discharge means.

Despite the availability of such structures for growing and cultivating plants, a similar development of space efficient structures for storage and display of cut flowers has not taken place. The state of the art for conserving space in the storage of cut flowers in refrigerated space is provision of conventional shelving, as shown in an article entitled "Adjustable Storage Shelves," *Florist's Review*, July 1986. Cut flower display units are also available in which a plurality of stepped receptacles are provided for cut flower display and sale, particularly at the retail level. Each of the stepped receptacles is provided with a water inlet means and a drain for filling and emptying the receptacles. While this type of display unit may provide more effective and attractive storage and display of cut flowers, it still requires frequent changes of water and thorough cleaning of the receptacles to reduce microbial populations and preserve the freshness of cut flowers.

Accordingly, it is an objective of the present invention to provide a method and apparatus for cut flower storage and display which prolongs the useful lifetime of cut flowers and the like.

It is another objective of the present invention to provide a method and apparatus for economical and attractive storage and display of cut flowers in a plurality of containers adjustably mounted on a support rack.

It is yet another objective of the present invention to provide a method and apparatus for cut flower storage and display which reduces cut flower maintenance costs, and particularly labor costs typically associated with the maintenance and preservation of cut flowers and the like.

It is yet another objective of the present invention to provide a method and apparatus for cut flower storage and display which substantially eliminates harmful microbial and algal populations simultaneously in a plurality of cut flower containers mounted on a support rack.

It is still another objective of the present invention to provide a system for liquid circulation and treatment which preserves the fresh appearance and prolongs the useful lifetime of cut flowers during storage and display.

It is yet another objective of the present invention to provide a system for liquid circulation and treatment whereby cooled liquid is circulated throughout a plurality of cut flower storage and display containers to preserve the fresh appearance and prolong the useful lifetime of cut flowers during storage and display.

It is still another objective of the present invention to provide an inexpensive, versatile storage and display assembly for cut flowers and the like, which is conveniently adaptable to various storage and display applications, and which is particularly suitable for use in retail outlets.

DISCLOSURE OF THE INVENTION

A cut flower storage and display container in accordance with this invention includes a generally planar bottom surface and a pair of side walls extending upwardly from two opposite edges of the bottom surface. An end wall extends upwardly along a third edge of the bottom surface between the pair of side walls. A top wall is joined to the side walls and end wall to define a liquid reservoir extending along a portion of the bottom surface of the cut flower storage and display container. The liquid reservoir is accessible from a generally rectangular opening defined by the bottom surface and upper edges of the two opposite side walls and the top wall. The bottom surface extends beyond the liquid reservoir to provide a cut flower supporting portion. The liquid reservoir serves to confine liquid at one end of the container when the bottom surface of the container is angled upwardly from the end wall. According to a preferred embodiment, the cut flower storage and display container is provided with liquid discharge means penetrating the liquid reservoir to maintain a desired liquid level in the reservoir.

Cut flower storage and display containers of the present invention are preferably mounted in spaced relationship at an angled orientation on a support rack to form at least one generally vertical column. According to a preferred embodiment, each container is pivotally mounted on a support rack for adjustment between a plurality of discrete angled positions. Suitable stationary or movable freestanding support racks may be provided for mounting a plurality of generally vertical containers in a plurality of columns to form modular storage and display assemblies having generally rectangular, circular, or other configurations. The storage and display assemblies may be provided with casters, or the like, so that they may conveniently be moved between storage, cleaning, and display locations.

A preferred embodiment of the cut flower storage and display assembly of the present invention incorporates a liquid circulation system including a primary reservoir for supplying circulating liquid to a plurality of containers mounted on a support rack, a pump means for conveying liquid to the uppermost containers, and distribution means for distributing liquid to the liquid reservoirs of each of the uppermost containers in a generally vertical column of containers. Utilizing the liquid circulation system of the present invention, liquid may be continuously or intermittently circulated to the uppermost containers to fill the liquid reservoirs of the uppermost containers to a desired liquid level, whereupon liquid is discharged from the uppermost containers into the liquid reservoirs of the adjacent lower containers until the liquid reservoirs of the adjacent lower reservoirs are filled to the desired liquid level, and liquid is similarly discharged to the next adjacent lower containers. Liquid is thus provided to fill the liquid reservoir of each container in a column to a desired liquid level sequentially from the uppermost to the lowermost container, and excess liquid is discharged from the lowermost containers into the primary reservoir. Due to the configuration and arrangement of liquid discharge means on each storage and display container, the liquid reservoir of each container remains filled to the desired liquid level as liquid is continuously or intermittently circulated through each column of storage and display containers.

The liquid circulation system of the present invention facilitates effective use of floral preservatives, algaecides, and the like, since proper dosages of floral preservatives, algaecides, and the like may be introduced in the primary reservoir and circulated through the liquid reservoir of each container mounted on a support rack assembly. Continuous or intermittent liquid circulation overcomes the problems associated with separately measuring proper dosages of floral preservatives, algaecides, and the like into each container each time the liquid is replaced.

According to a preferred embodiment of the cut flower storage and display assembly of the present invention, the liquid circulation system includes a liquid filtration means for filtering substantially all particulate material exceeding a threshold particle size out of the circulating liquid supply, including substantially all microbes which have been shown to have a detrimental effect on the health and appearance of cut flowers. The rate of liquid circulation and the type of liquid filtration means utilized may be adapted for different applications, but the combination of liquid circulation, liquid filtration, and effective use of a floral preservative and an algaecide significantly prolongs the useful lifetime and preserves the fresh appearance of cut flowers and plants.

In addition to providing liquid circulation and filtration, it is desirable, for many applications, to circulate cooled liquid throughout a plurality of cut flower storage and display containers. Circulation of cooled liquid among cut flower storage and display containers efficiently chills the cut flowers and the atmosphere surrounding them, without requiring refrigeration of the entire storage or display area. It is believed that the use of cooled liquids maintains the blooms of cut flowers in a bud-like or closed state for an extended period of time.

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings, wherein.

BEST MODE OF CARRYING OUT THE INVENTION

Figure 1:
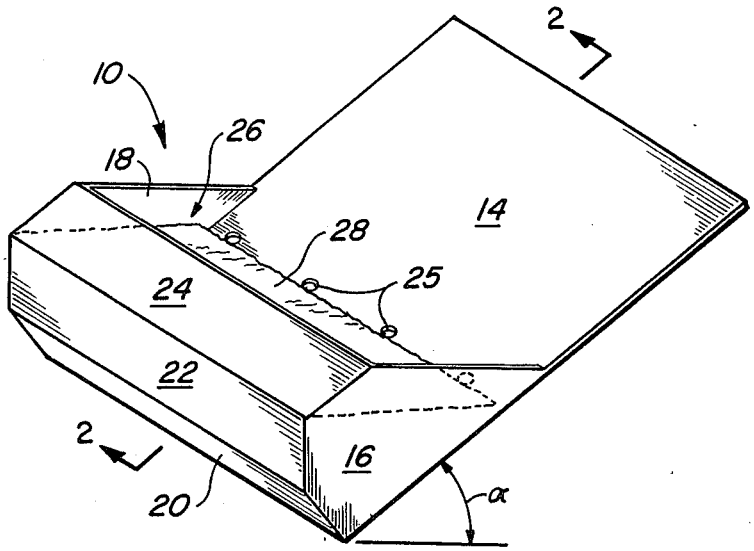
FIG. 1 shows a perspective view of a cut flower storage and display container in accordance with the present invention.
Figure 2:
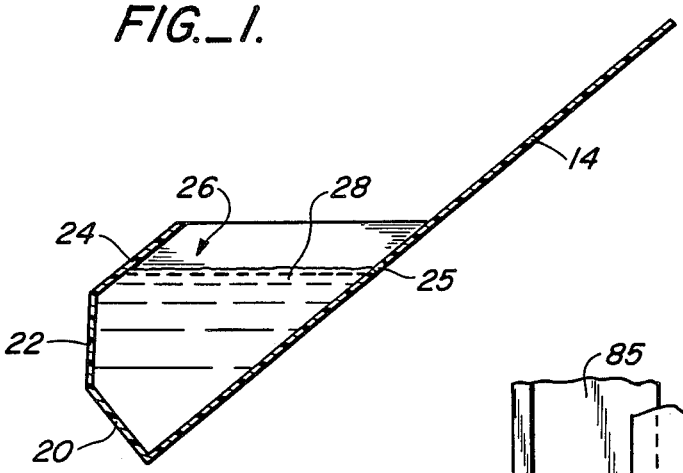
FIG. 2 shows a cross-sectional view of a cut flower storage and display container taken substantially along the line 2—2 of FIG. 1.
Figure 5:
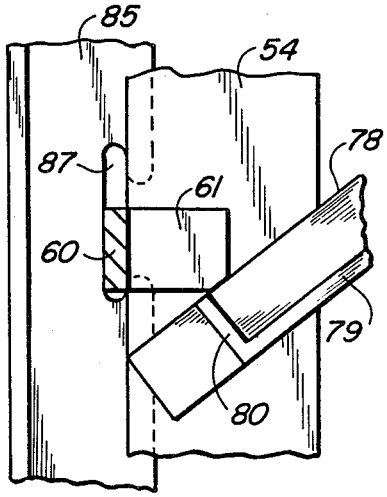
FIG. 5 shows an enlarged view of the area indicated by the line 5—5 in FIG. 4.

As shown in FIGS. 1 and 2, cut flower storage and display container 10 includes generally planar bottom surface 14, on which cut flowers or the like rest when the container is oriented upwardly from the horizontal, as shown. Side walls 16 and 18 extend upwardly, preferably at generally right angles from two opposite edges of bottom surface 14. End wall 20 extends upwardly, preferably at a generally right angle, from a third edge of bottom surface 14 between side walls 16 and 18. Top wall 24 extends between side walls 16 and 18, and is preferably joined to bottom wall 20 by means of angled intermediate wall 22. Side walls 16 and 18, bottom wall 20, intermediate wall 22 and top wall 24, along with the bottom wall 14, define a liquid reservoir 26 for confinement of liquid to a desired liquid level 28. Liquid reservoir 26 extends along only a portion of bottom surface 14, with the remaining portion of bottom surface 14 serving as a cut flower support member.

Bottom surface 14 of the cut flower storage and display container is provided with a liquid discharge means in proximity to liquid reservoir 26, such as a plurality of apertures 25 extending between side walls 16 and 18. Apertures 25 serve to maintain the liquid level in liquid reservoir 26 at desired liquid level 28 when the container 10 is inclined as shown, by allowing excess liquid to drain from reservoir 26 through apertures 25. When storage and display containers are mounted on a suitable rack, bottom surface 14 of the container is angled at an angle $\alpha$ from the horizontal, and angle $\alpha$ is preferably from about 30 to about 70 degrees, most preferably about 40 to about 60 degrees.

Figure 3:
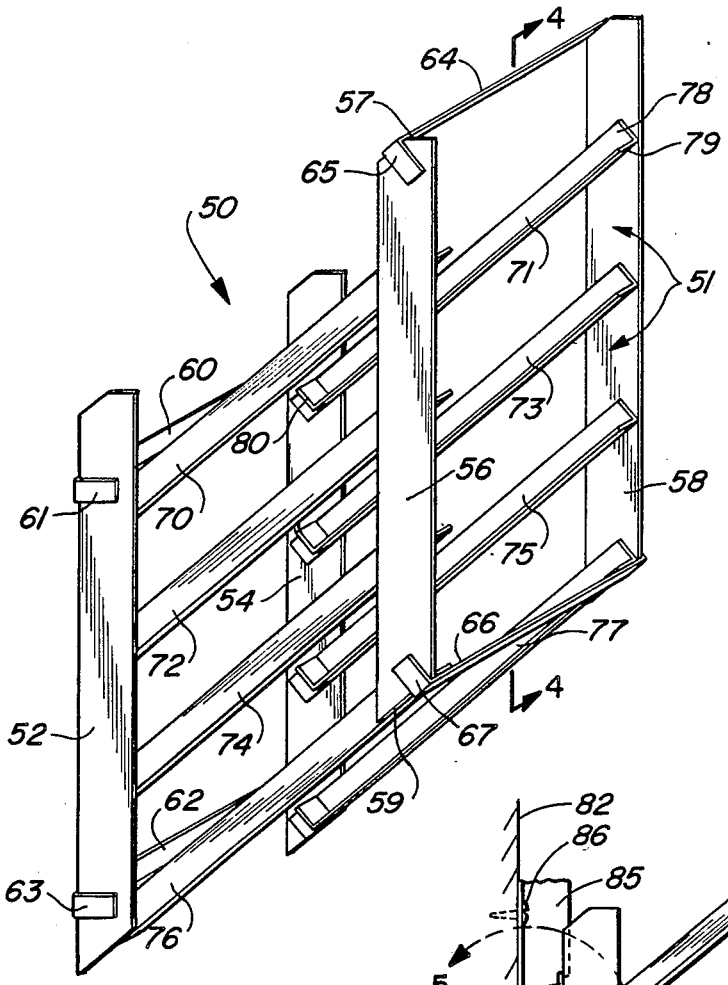
FIG. 3 shows a perspective view of a storage and display rack in accordance with the present invention for receiving the storage and display containers of FIGS. 1 and 2.
Figure 4:
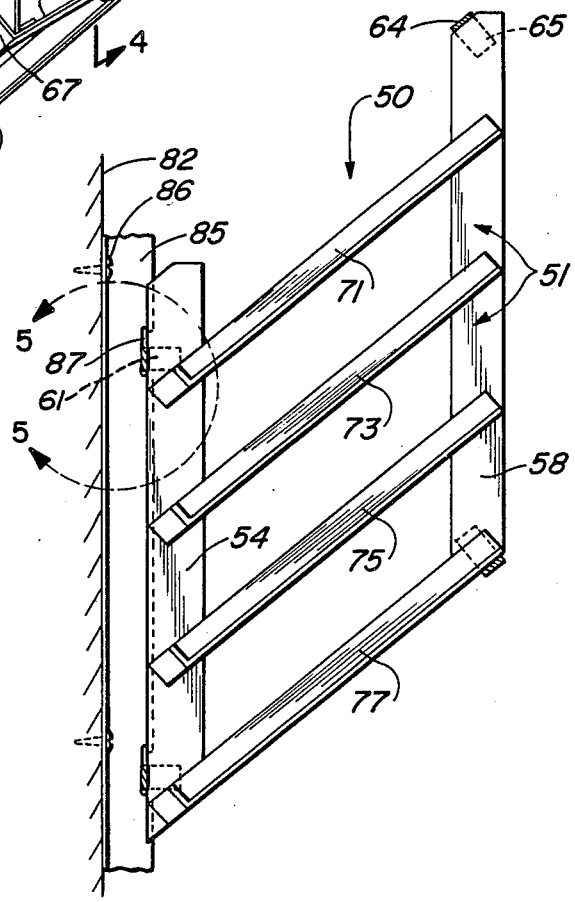
FIG. 4 shows a cross-sectional view of the storage and display rack of FIG. 3 taken substantially along line 4—4 of FIG. 3.

FIGS. 3 and 4 illustrate storage and display rack 50 for supporting a plurality of cut flower storage and display containers 10. Rack 50 may be mounted on a wall or otherwise supported in a generally vertical orientation for insertion of a plurality of containers angled upwardly from the horizontal and arranged in a generally vertical column. According to a preferred embodiment, rack 50 comprises at least four vertical supports 52, 54, 56 and 58. Rear vertical supports 52 and 54 are joined by horizontally oriented braces 60 and 62 having angled ends 61 and 63, respectively, brazed or otherwise fastened flush to rear vertical supports 52 and 54. Horizontally oriented braces 64 and 66 join front vertical supports 56 and 58 in a similar manner by means of angled ends 65 and 67, respectively, fastened to front vertical supports 56 and 58. Braces 64 and 66 are attached to front vertical supports 56 and 58 at their upper and lower edges 57 and 59, respectively, so that the front side 51 of storage and display rack 50 is unobstructed for sliding insertion and removal of storage and display containers 10.

Angled bars 70, 72, 74 and 76 join rear vertical support 52 to front vertical support 56, and angled bars 71, 73, 75 and 77 similarly join rear and front vertical supports 54 and 58, respectively. Each of the angled bars preferably comprises a vertical edge 78 for attachment to the vertical supports and a supporting edge 79 projecting substantially perpendicular to vertical edge 78 for supporting bottom surface 14 of the storage and display containers. Angled bars 70–77 are preferably inclined at an angle of about 30 to about 70 degrees from the horizontal, so that they support cut flower storage and display containers at the corresponding angled orientation. Tabs 80 are preferably provided near the rear edges of angled bars 70–77 in proximity to rear vertical supports 52 and 54 extending upwardly at right angles to supporting edges 79, to provide stops against which bottom walls 20 of storage and display containers rest when the containers are mounted in storage and display rack 50.

Storage and display racks 50 may be hung on the walls of a refrigerated cooler to store cut flowers, or they may be mounted on a stationary or movable generally vertical support structure in a retail outlet to display cut flowers for sale. According to one embodiment, support members 85 may be mounted vertically on wall structure 82 by means of fasteners such as screws 86, preferably at studs in the wall for extra support. Support members 85 are provided with a plurality of notches 87 in which horizontally oriented braces 60 and 62 are mountable to hold storage and display racks 50 in place. The configuration of notches 87 permits support members 85 to be mounted vertically on support structure 82 without reference to a top or bottom direction. Although the storage and display rack illustrated in FIGS. 3 and 4 is designed to carry four containers, it is readily apparent that a plurality of storage and display containers, and preferably from about two to about twelve containers, may be carried by a suitably designed storage and display rack. A plurality of cut flower storage and display racks 50 may be mounted in combination on a support structure to create an impressive display of cut flowers.

Figure 6:
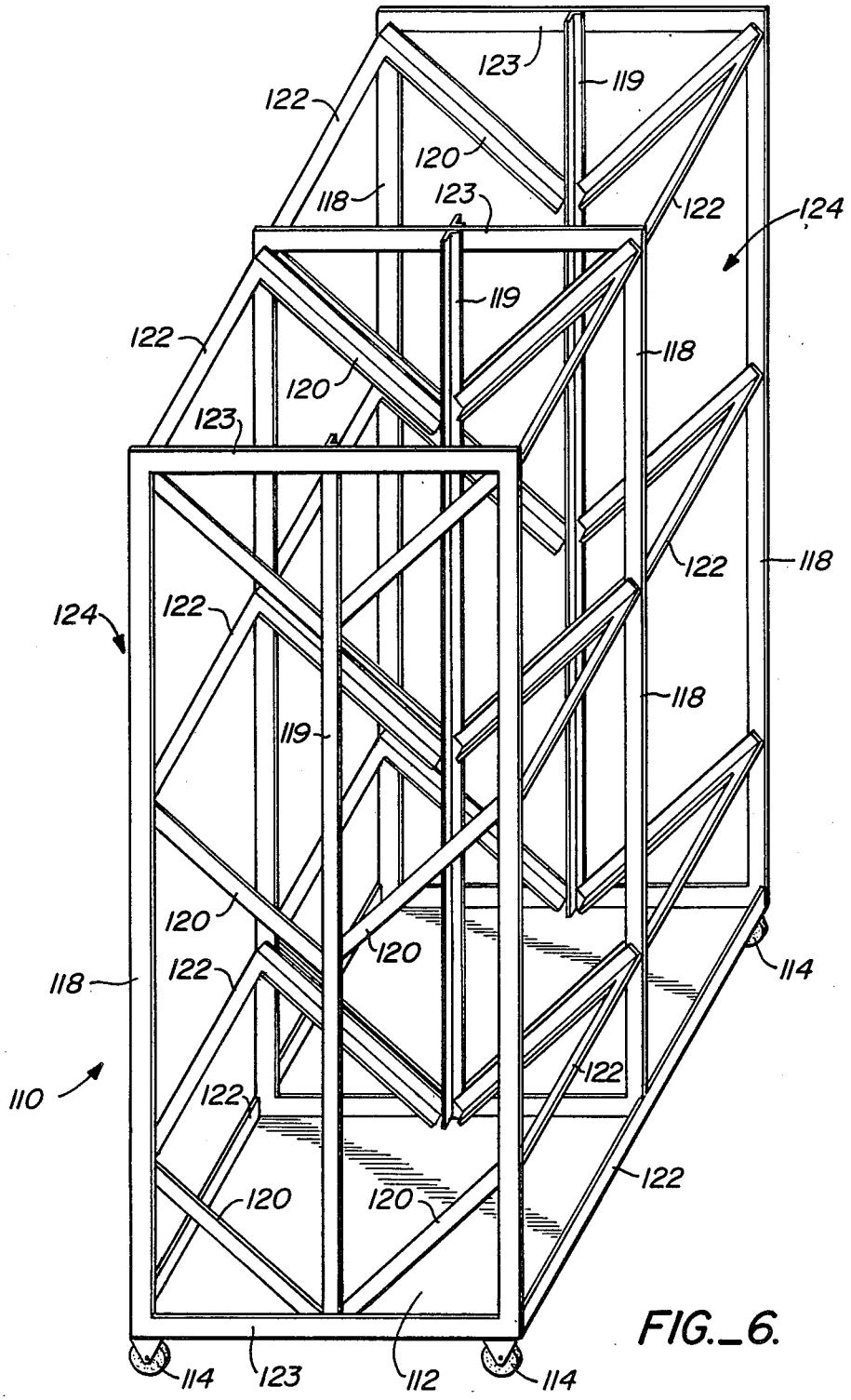
FIG. 6 shows a perspective view of a movable cut flower storage and display tower in accordance with the present invention for use with the containers of FIGS. 1 and 2 and the rack of FIGS. 3 and 4.

FIG. 6 illustrates a movable tower 110 which is capable of supporting twelve racks 50 for storage of cut flowers, such as in a walk-in cooler, as well as for display of cut flowers in a retail outlet. Movable tower 110 has a flat base 112 with casters 114 mounted on the underside of base 112. Vertical supports 118 and 119 extend upwardly at substantially right angles from the base 112. Horizontal support members 122 extend between and are fastened to adjacent outer vertical supports 118 at intervals along the height of outer vertical supports 118. Horizontal support members 123 provide additional support for outer and inner vertical supports 118 and 119, respectively, and are mounted at least at the top and base of the movable tower.

Angled supports 120 extend between outer vertical supports 118 and inner vertical supports 119, and are inclined at an angle of about 30 to about 70 degrees and preferably about 40 to about 60 degrees with respect to the horizontal. A receiving space 124 for insertion of a storage and display rack 50, as described above, is defined by each set of vertical supports joined by two opposite angled supports 120 and a horizontal support member 122. Storage and display racks 50 are thus insertable into movable tower 110 and supportable therein so that vertical supports 52, 54, 56 and 58 of the storage and display rack remain in a vertical orientation. According to the embodiment illustrated in FIG. 6, outer vertical supports 118, inner vertical supports 119, angled supports 120, and horizontal support members 122 and 123 form the framework defining eight receiving spaces 124 for slidable insertion of eight storage and display racks 50.

It will be readily apparent that although movable tower 110 has been described as having eight receiving spaces in which storage and display racks may be slidably mounted, the movable tower of the present invention may be adapted to provide from about two to twelve or more receiving spaces, and different configurations may be suitable for particular applications. For example, for some applications it may be desirable to provide receiving spaces for insertion of storage and display containers from a single direction rather than two opposite directions, as shown in FIG. 6. The modular nature of the storage and display rack and movable tower of the present invention facilitates the design and assembly of storage and display units suited for a variety of purposes and environments.

In addition to storage and display, movable tower 110 may be used to transport racks 50 and cut flowers stored therein between a storage location such as a cooler and individual point of sale stations, with one or more of the storage and display racks being removed from the tower at each station, and later returned to the tower for transport to the storage cooler. A modified form of the movable tower may also be provided, in which notches similar to those described above with reference to support members 85 are provided on the vertical supports, so that a plurality of racks 50 are mountable on the tower in substantially the same manner that they are mountable on the support structure shown in FIG. 4.

The cut flower storage and display containers, racks and towers of the present invention provide high density storage and display of cut flowers and the like, which provides more efficient use of expensive cooler space and retail sales space in a store. The storage and display rack of the present invention provides increased storage and display capacity per unit surface area. For example, the rack illustrated in FIG. 3 provides six cubic feet of cut flower storage or display space per square foot of floor space, while the tower illustrated in FIG. 6 provides 4.5 cubic feet of flower storage and display space per square foot of floor space in the configuration shown.

Although cut flower storage and display containers, racks, and towers of the type described above make highly efficient use of space while providing attractive and creative display possibilities, they require frequent and labor intensive maintenance to preserve the fresh appearance of cut flowers. The liquid circulation system of the present invention, utilized in combination with the storage and display assemblies of the present invention, significantly reduces the maintenance required to preserve the fresh appearance of cut flowers and, in fact, in most cases prolongs the useful lifetime of cut flowers.

Figure 7:
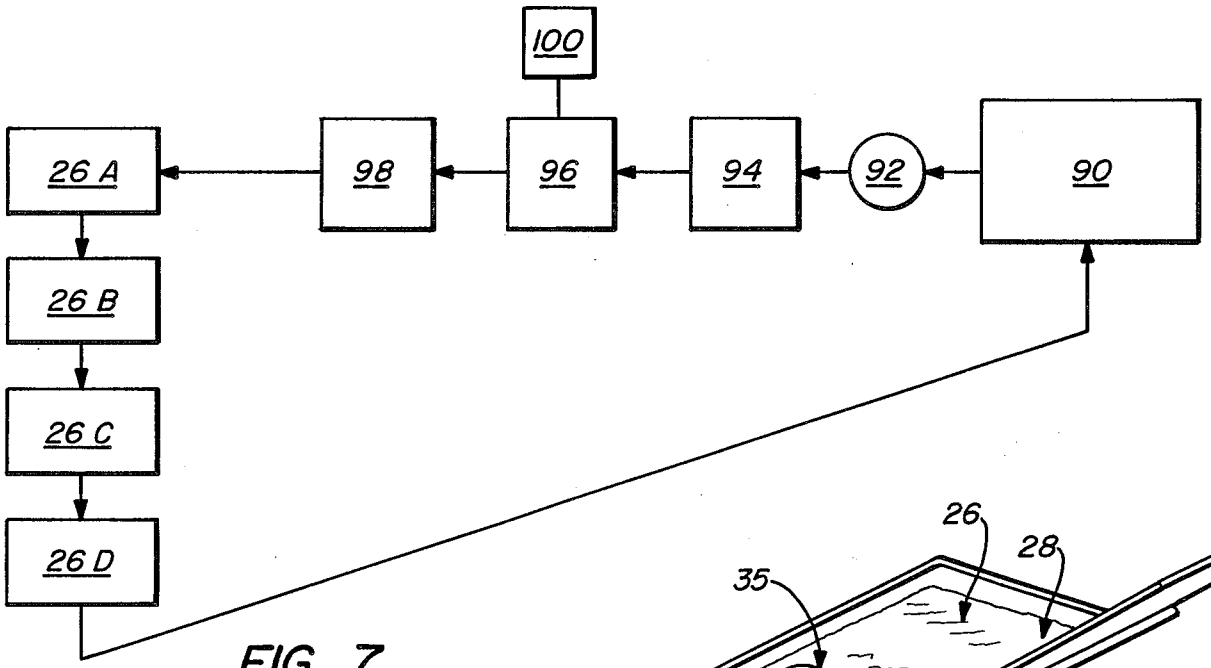
FIG. 7 shows a schematic flow diagram illustrating the liquid circulation system for use with cut flower storage and display assemblies according to the present invention.

As shown schematically in FIG. 7, the liquid circulation system of the present invention includes primary liquid reservoir 90 and pump 92 for conveying liquid from primary reservoir 90 to the liquid reservoir 26A of the uppermost storage and display container in a generally vertical column of containers mounted on a rack, tower, or the like, as described above. According to one embodiment of the liquid circulation system of the present invention, liquid provided in primary reservoir 90, located below liquid reservoir 26D of the lowermost storage and display container in the column, is conveyed by pump 92 through a suitable conduit to liquid reservoir 26A of the uppermost storage and display container in the assembly. When liquid reservoir 26A has been filled to the desired liquid level 28, excess liquid is discharged through liquid discharge means in the container. Due to the arrangement of storage and display containers in a vertical column, liquid discharged from liquid reservoir 26A of the uppermost container flows into liquid reservoir 26B of the adjacent lower container. In this fashion, a plurality of storage and display containers arranged in a vertical column may be sequentially filled with liquid to the desired liquid level. When liquid reservoir 26D of the lowermost container has been filled to the desired liquid level, excess liquid is discharged into primary reservoir 90. Thus, a steady-state system may be established for circulating liquid through liquid reservoirs of a plurality of storage and display containers arranged in at least one vertical column. Liquid circulation may be provided continuously or intermittently according to the system of the present invention.

A similar system may be employed for providing liquid circulation through a plurality of storage and display containers arranged in a plurality of vertical columns, such as provided by movable tower 110. Liquid distribution means 98 is preferably provided to divert liquid from a liquid conduit in communication with the pump to the liquid reservoir of the uppermost storage and display container in each vertical column of containers. Suitable liquid distribution means are well known in the art.

According to a preferred embodiment of the liquid circulation system of the present invention, liquid filtration means 94 is provided for filtration of substantially all particulate material larger than a threshold particle size. Utilization of filtration means 94 provides removal of substantially all microbes which have a detrimental effect on the health and appearance of cut flowers from the circulating liquid, thereby significantly prolonging the useful lifetime of cut flowers stored and/or displayed in containers arranged in vertical columns. Filtration means capable of filtering out substantially all particles having a particle size in excess of about 1.0 micron, and preferably about 0.45 micron are known in the art, and are preferred for use in the circulation system of the present invention. Filtration means comprising pleated media filter cartridges having a pore size of about 0.45 micron, permitting a high liquid flow rate and having a high contaminant holding capacity are especially preferred. Preferred filter cartridges and filter cartridge housings are sold under the mark DUO-FINE and are available from FILTERITE, 2033 Greenspring Drive, Timonium, Maryland. Circulation systems including a pleated media filter cartridge according to the present invention require low maintenance, and the filter cartridges may be re-used after soaking in a chlorine solution to destroy the microbes.

One important advantage provided by the liquid circulation system of the present invention is that proper dosages of floral preservatives, algaecides, and the like may be introduced to the liquid in the primary liquid reservoir and circulated thereafter to the liquid reservoir of each storage and display container. This arrangement thus provides effective use of floral preservatives, algaecides, and the like, and significantly reduces the cost, measured in maintenance time, of using such beneficial compounds.

An aqueous liquid, typically water, is generally circulated to cut flowers by means of the circulation system of the present invention. Circulation of liquid including proper dosages of floral preservative and algaecide provides convenient and effective use of floral preservative and algaecide in the liquid reservoirs of all storage and display assemblies in a rack or tower assembly. Filtration of the circulating liquid, which removes substantially all submicronic particles, including substantially all harmful microbes, substantially eliminates the harmful microbial populations in the liquid reservoirs of all storage and display containers simultaneously. Since microbes are continuously or intermittently filtered out of the circulating liquid, and algal populations do not accumulate in the presence of an effective algaecide, the circulation system of the present invention provides a much cleaner operating system. In fact, the maintenance requirements for storage and display assemblies utilizing the liquid circulation system of the present invention are minimal. For example, while conventional containers for storage and display of cut flowers and the like should be emptied of liquid, thoroughly scrubbed, and refilled with fresh liquid at least once each day, the storage and display containers of the present invention used in conjunction with a liquid circulation and filtration system require thorough cleaning about once each month. This represents a tremendous savings in maintenance costs, in addition to prolonging the useful lifetime of cut flowers.

According to an especially preferred embodiment of the liquid circulation system of the present invention, liquid cooling means 96 is provided to cool circulating liquid to temperatures of from about 32° to about 50° F., and preferably from about 32° to 39° F.. It is believed that circulation of cooled liquid prolongs the useful lifetime of cut flowers by maintaining blooms in a bud-like or closed state for a longer period of time. Ventilation means 100 may be provided, if desired, to exhaust heat generated by cooling means 96.

Figure 8:
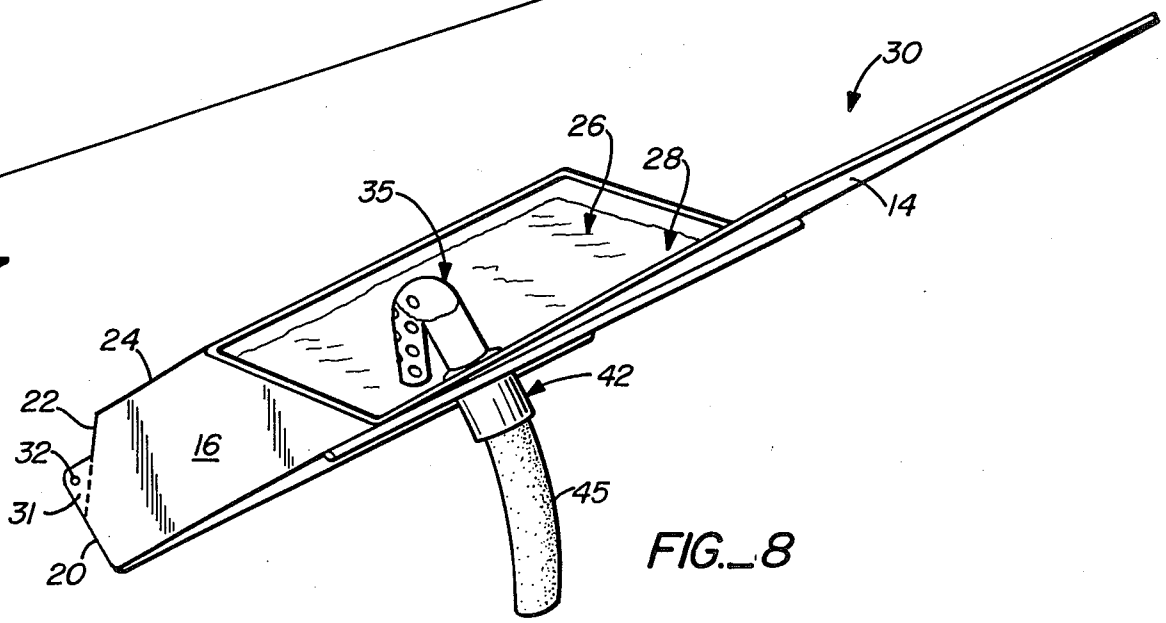
FIG. 8 shows a perspective view of another embodiment of a cut flower storage and display container particularly suitable for use with a liquid circulation system according to the present invention.
Figure 9:
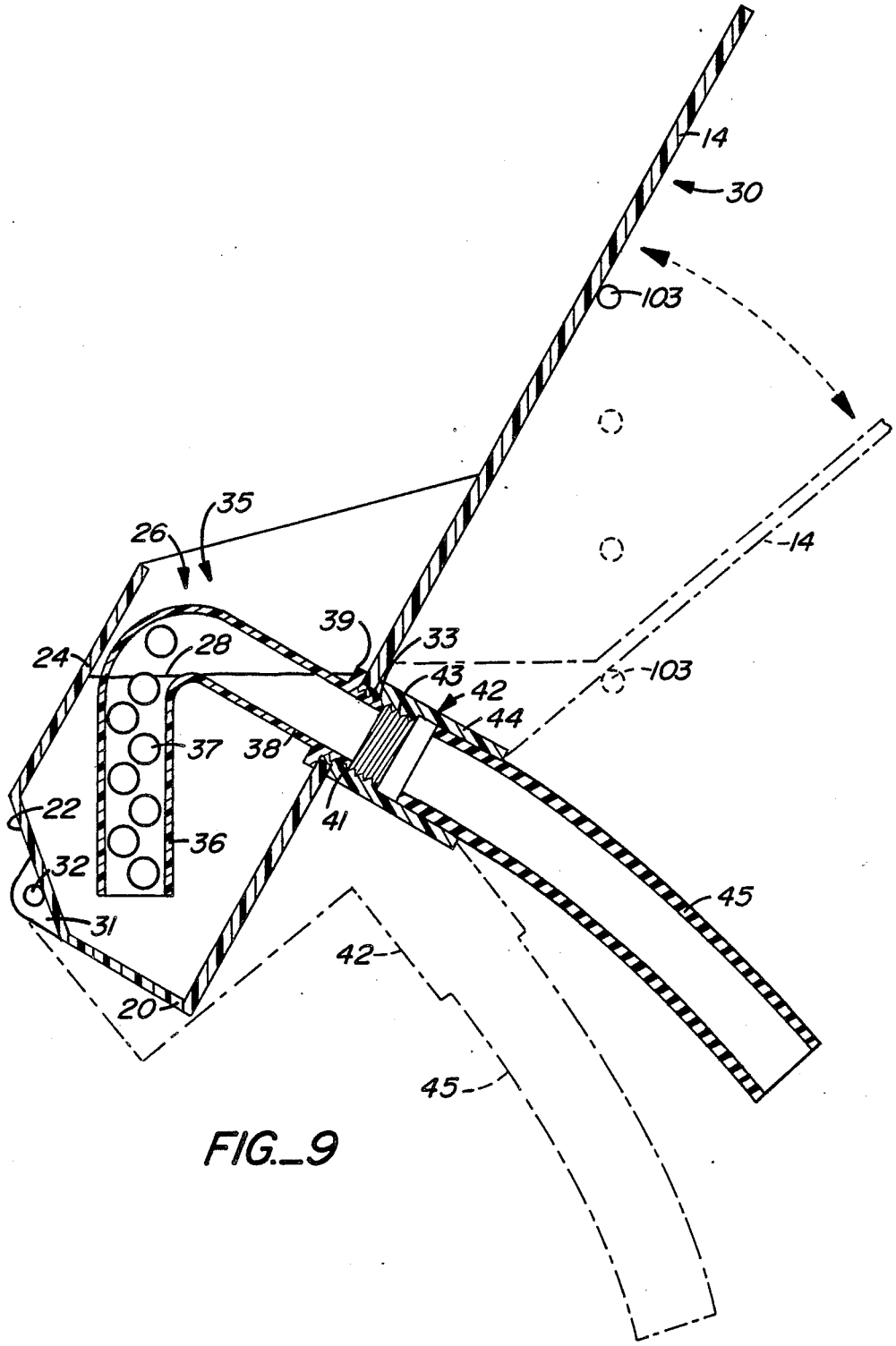
FIG. 9 shows a cross-sectional view taken substantially along the longitudinal midline of the cut flower storage and display container shown in FIG. 8.

FIGS. 8 and 9 illustrate a preferred embodiment of a cut flower storage and display container adapted to be adjustably mounted in a cut flower storage and display rack, and specially adapted for use with the liquid circulation system of the present invention. Cut flower storage and display container 30 comprises generally planar bottom surface 14, side walls 16 and 18, end wall 20, angled intermediate wall 22 and top wall 24 defining liquid reservoir 26, substantially as shown in FIGS. 1 and 2, and described above with reference to cut flower storage and display container 10. Container 30 is additionally provided with at least two tab members 31 projecting from intermediate wall 22 in a plane substantially parallel to the plane of side walls 16 and 18. Tab members 31 are preferably provided at the intersection of side walls 16 and 18 with intermediate wall 22, and additional tab members may be provided for additional support at intervals along intermediate wall 22 between side walls 16 and 18. Cut flower storage and display container 30 is pivotally mountable on a support rack by means of a mounting rod received through bores 32 in tab members 31. When containers 30 are pivotally mounted in a display rack in this fashion, the axis of the mounting rod represents the pivot axis for rotation of containers 30.

Tubular liquid discharge means 35 is mounted on bottom surface 14 of cut flower storage and display container 30. Liquid discharge means 35 maintains a desired liquid level 28 in liquid reservoirs 26, and permits discharge of liquid from the liquid reservoir when the liquid exceeds desired level 28. Tubular liquid discharge means 35 preferably comprises a generally V-shaped tubular member having first leg 36 and second leg 38 oriented at an acute angle with respect to one another. First leg 36 is preferably oriented at an angle of about 20 to about 80 degrees with respect to second leg 38, and most preferably at an angle of about 60 degrees.

A plurality of apertures 37 is provided in first leg 36 of tubular liquid discharge means 35, with an uppermost aperture positioned substantially at the intersection of first leg 36 with second leg 38. In practice, when liquid is introduced into liquid reservoir 26 and reaches desired liquid level 28, excess liquid is discharged from the reservoir through second leg 38 of the tubular liquid discharge means. Tubular liquid discharge means 35 thus regulates the liquid level in the liquid reservoir of each storage and display container to prevent overflow of liquid from the reservoir and to maintain desired liquid level 28.

A plurality of relatively small apertures is preferably provided in first leg 36 of tubular liquid discharge means 35 to prevent large suction forces from developing at a single or a few apertures. Provision of a plurality of relatively small apertures 37, preferably from about 8 to about 24 apertures, preferably having a diameter of from about ¼ inch to ¾ inch, ensures that forces developed as a result of liquid withdrawal are evenly distributed, and reduces the likelihood of clogging of the apertures by plant matter which would prevent or reduce liquid discharge. Even if some of the apertures become clogged, the liquid level in the tubular liquid discharge means is maintained at the level in the liquid reservoir, and liquid will be withdrawn from the reservoir through second leg 38 of the tubular liquid discharge means when the desired liquid level has been exceeded, regardless of the angled orientation of the container with respect to the horizontal. The uppermost aperture is preferably located above the desired liquid level to prevent a siphon effect from developing within the tubular liquid discharge means.

As shown in FIG. 9, tubular liquid discharge means 35 is preferably mounted with second leg 38 projecting generally perpendicularly from bottom surface 14 of storage and display container 30. Bottom surface 14 of cut flower storage and display container 30 is preferably provided with bore 33 for receiving second leg 38 of the liquid discharge means. Second leg 38 is preferably provided with flange 39 having a diameter greater than that of bore 33. Threaded terminal end 41 of second leg 38 of the liquid discharge means is inserted through bore 33, and is retained therein by means of adapter member 42 provided with internally threaded portion 43 for engagement of threaded terminal end 41 of second leg 38. Adapter member 42 is preferably tightened on the threaded terminal end of the liquid discharge means to rigidly mount tubular liquid discharge means 35 on the cut flower storage and display container and to provide a liquid-tight seal. Adapter member 42 is also preferably provided with extender portion 44, and tubing 45 may be mounted on adapter member 42 for purposes which will be explained more fully below.

Figure 10:
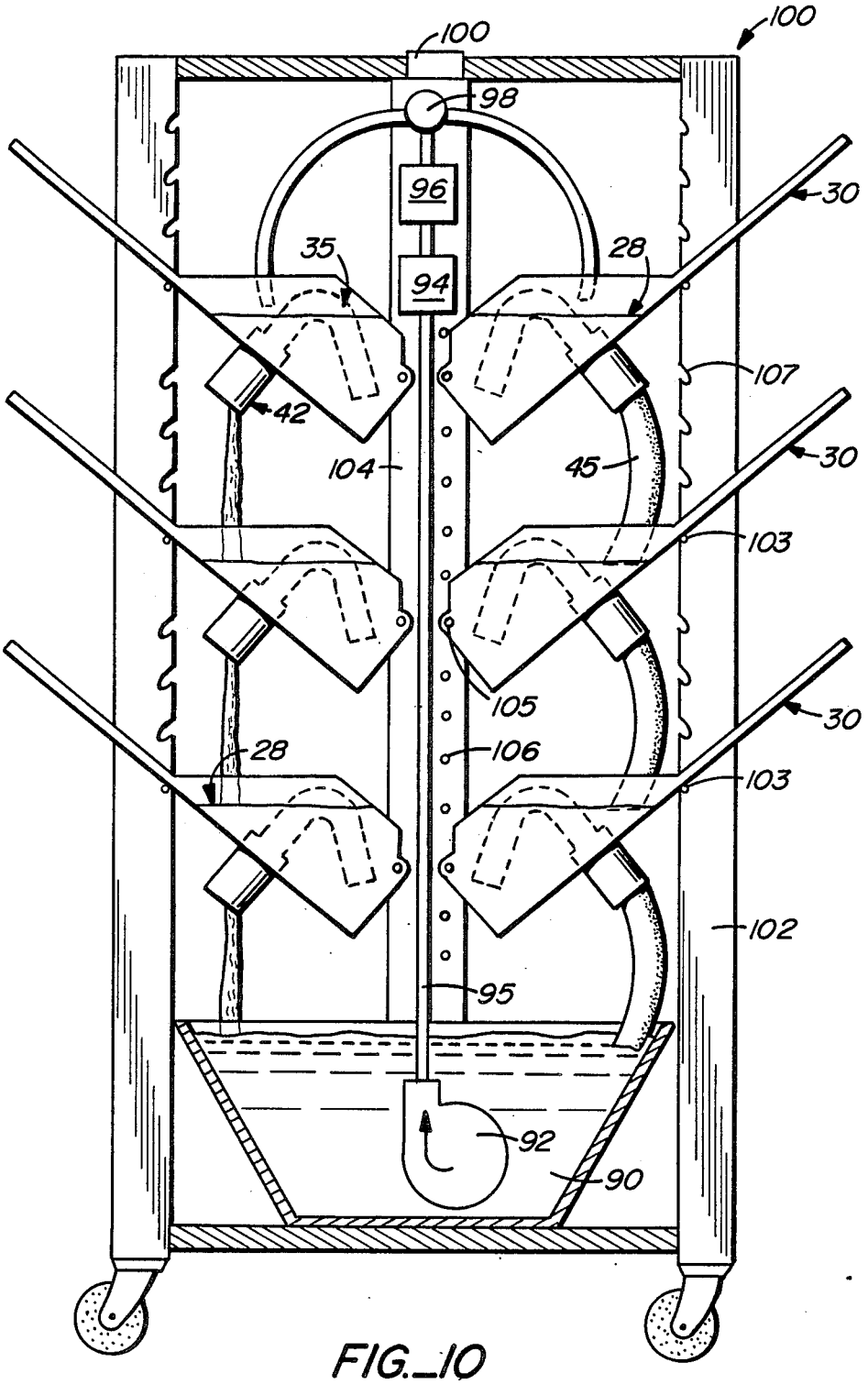
FIG. 10 shows a diagrammatic side elevation view, partially in section, of the storage and display containers of FIGS. 8 and 9 adjustably mounted on a movable storage and display rack according to the present invention utilizing a liquid circulation system.

FIG. 10 illustrates a plurality of cut flower storage and display containers 30 pivotally mounted on display rack assembly 100 including a liquid circulation system. Display rack assembly 100 preferably comprises a plurality of outer vertical supports 102 and inner vertical supports 104 arranged for receiving one or more columns of vertically spaced containers. Inner vertical supports 104 are provided with a plurality of bores 106 or the like, for receiving inner mounting rods 105 for pivotally mounting containers 30 on inner vertical supports 104. Inner mounting rod 105 is preferably received through bores 32 in tab members 31 on the containers, and is mounted in bores 106, or suitable notches in inner vertical supports 104. Container 30 is thus pivotally mountable on the support rack and rotatable about a pivot axis represented by axis of inner mounting rod 105.

It is desirable to provide adjustment of the angled orientation of containers 30 with respect to the horizontal to accommodate storage and/or display of different varieties and sizes of cut flowers and plant materials. According to the preferred embodiment illustrated in FIG. 10, cut flower storage and display containers 30 are maintained in an angled orientation by means of outer mounting rods 103 which are retainable in one of a plurality of notches 107 provided in outer vertical supports 102. Outer mounting rod 103 supports the bottom surface of containers 30 in an angled orientation with respect to the horizontal, and multiple notches are preferably provided for adjustable positioning of each container 30 in a plurality of angled orientations.

FIG. 9 illustrates container 30 supported by outer mounting rod 103 in the uppermost angled position and indicates, in phantom lines, the position of container 30 when outer mounting rod 103 is positioned in the lowermost position. The orientation of containers 30 is preferably adjustable between angles of about 30 degrees to about 70 degrees from the horizontal, and most preferably about 40 degrees to about 60 degrees from the horizontal. One advantage of the pivotal container mounting arrangement illustrated in FIGS. 9 and 10 is that upon removal of outer mounting rod 103, containers 30 are inverted for convenient liquid disposal and container cleaning.

FIG. 10 also illustrates incorporation of a water circulation system in cut flower storage and display assembly 100 of the present invention. Primary liquid reservoir 90 is preferably provided in a lower interior portion of the storage and display assembly. Pump means 92 is provided in proximity to primary reservoir 90 for conveying liquid through liquid conduit 95 from primary reservoir 90 to the uppermost storage and display containers mounted on the display assembly. Pump means 92 preferably comprises a submersible pump which may be mounted directly in the primary reservoir. Liquid conduit 95 is in communication with pump means 92 for conveying circulating liquid from primary reservoir 90 to liquid distribution means 98 provided near the top of the storage and display rack assembly for distributing liquid to the uppermost container in each column of containers. Filtration means 94, liquid cooling means 96, and ventilation means 100 are also preferably provided near the top of the storage and display rack assembly.

As circulating liquid is pumped from primary reservoir 90 and distributed to each of the uppermost containers, the liquid reservoirs of the uppermost containers are filled to the desired level, and excess liquid is subsequently discharged through tubular liquid discharge means 35 and directed to the liquid reservoir of the next lowermost container. The liquid reservoir of the next lowermost container is then filled with liquid to the desired liquid level and liquid is then discharged through the liquid discharge means to the next lowermost container. In this fashion, each cut flower storage and display container in a generally vertical column is filled with circulating liquid to the desired liquid level. The liquid discharge means of the lowermost container in each vertical column discharges circulating liquid directly into the primary reservoir. Circulating liquid may thus be continuously or intermittently circulated throughout a plurality of cut flower storage and display containers arranged in generally vertical columns. Although two columns of containers are illustrated for the sake of simplicity in FIG. 10, it will be readily apparent that additional columns of containers may be serviced by a single central liquid reservoir and pump, and a suitable liquid distribution means providing a supply of liquid to the uppermost storage and display container in each column.

FIG. 10 also illustrates the optional use of tubing 45 mounted in adapter member 42. According to one embodiment shown on the left side of FIG. 10, liquid flows from the end of extender portion 44 of adapter member 42 into the liquid reservoir of the adjacent lower container. While this arrangement is desirable for many applications, the sound and splashing resulting from the free flow of circulating liquid may be unacceptable for certain applications. Tubing 45 may then be provided projecting from extender portion 44 of adapter member 42 to enclose and confine the circulating liquid flowing from one container to the adjacent lower container.

The method of the present invention for prolonging the useful life of cut flowers incorporates continuous or intermittent circulation of liquid through liquid reservoirs of storage and display containers. According to a preferred embodiment of the method of the present invention, liquid is preferably continuously circulated at a rate which provides replacement of liquid in the liquid reservoir of each container every 15 minutes to about four hours, and preferably about 30 minutes. Incorporation of a filtration step is especially preferred to remove substantially all particulate matter having a particle size in excess of a threshold value of about 0.45 microns. Suitable dosages of a floral preservative, such as Floralife and an algaecide, are preferably introduced into the primary reservoir so that the circulating liquid comprises a suitable concentration of both floral preservative and algaecide. Elimination of the microbial and algal populations of the circulating liquid and circulation of floral preservative and nutrients substantially prolongs the useful life of cut flowers and plant materials.

Figure 11:
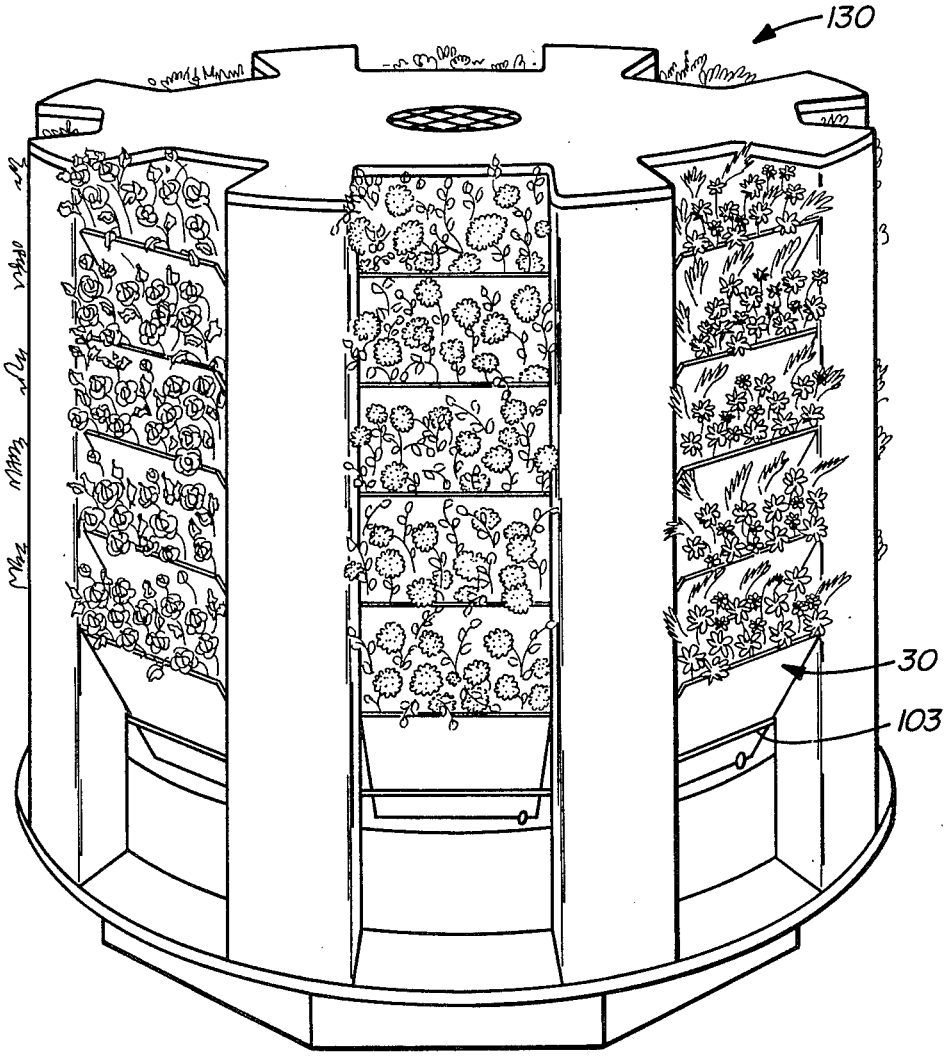
FIG. 11 shows a perspective view of a cut flower storage and display assembly according to the present invention having eight vertical columns of containers arranged in a generally circular arrangement.

Many different configurations of display rack assemblies may be provided utilizing the cut flower storage and display containers, racks, and/or liquid circulation system of the present invention. FIG. 11 illustrates a preferred embodiment wherein a plurality of containers arranged in generally vertical columns are mounted in storage and display assembly 130 having a generally circular configuration. This embodiment is especially suitable for storage and/or display of from about six to about twelve vertical columns of cut flower containers. The display rack assembly illustrated in FIG. 11 preferably incorporates the pivotal container mounting feature described above with reference to FIG. 10, and it also preferably incorporates a liquid circulation system similar to that illustrated in FIG. 10. According to an especially preferred embodiment of the cut flower storage and display assembly of FIG. 11, the primary reservoir comprises a tank having a generally annular doughnut configuration for receiving water from the lowermost containers in each of the generally vertical columns. Storage and display assembly 130 may be stationary or movable and provides attractive floral display having a high display capacity per unit floor area.

Figure 12:
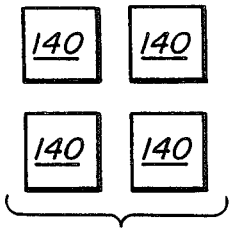
FIG. 12 illustrates, schematically, a cut flower storage and display assembly having three vertical columns of containers arranged in a generally rectangular arrangement.
Figure 13:
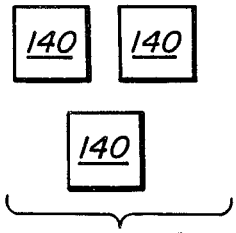
FIG. 13 illustrates, schematically, a cut flower storage and display assembly having four vertical columns of containers arranged in a generally triangular arrangement.

FIGS. 12 and 13 show schematic representations illustrating preferred configurations for modular cut flower storage and display assemblies according to the present invention. Each rectangular form 140 represents a vertical column of storage and display containers mounted on a support rack. Utilizing combinations of the modular assemblies illustrated in FIGS. 11 and 12, cut flower storage and display assemblies having a wide variety of configurations and storage and display capacity may be arranged.

Cut flower storage and display containers 10 and 30 are desirably molded from a rigid plastic material, such as high impact polystyrene or a similar plastic material, such as polyethylene, polypropylene, or the like. Cut flower storage and display containers may, however, be fabricated from other rigid materials, such as suitable metals, if desired. Suitable materials are well known in the art. Rack 50 is desirably fabricated from suitable rigid metallic components, such as aluminum or the like, or rigid, high strength plastic materials. Suitable materials are well known in the art. Liquid discharge means 35 and adapter member 42 preferably comprise a rigid, high strength plastic material, or the like, and many suitable materials are known in the art.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for prolonging the useful life of fresh cut flowers in a bud-like or closed state comprising:

arranging fresh cut flowers in a plurality of cut flower storage and display containers positioned in a vertically stacked relationship forming at least one generally vertical column, each of said containers supported at an angled orientation from the horizontal, and each said cut flower storage and display container having a liquid reservoir and a flower supporting portion;

circulating liquid from a primary reservoir to an uppermost storage and display container in each said generally vertical column;

filling said liquid reservoir of said uppermost storage and display container in each said generally vertical column to a threshold liquid level;

maintaining said threshold liquid level in said uppermost storage and display container in each said generally vertical column by discharging liquid from said uppermost storage and display container after said threshold liquid level is attained to said liquid reservoir of the adjacent lower storage and display container;

filling said liquid reservoirs of each said container in each said column sequentially to said threshold liquid level and maintaining said threshold liquid level in each said container by discharging liquid to said liquid reservoir of the adjacent lower container after said threshold liquid level is attained;

collecting liquid discharged from a lowermost container in each said generally vertical column in said primary reservoir for recirculation; and separately cooling said liquid to temperatures of about 32° to about 50° F., thus to maintain blooms of the flowers in the budlike or closed state for a longer period of time.

2. A method according to claim 1, additionally comprising filtering said liquid to remove substantially all particles having a particle size greater than about 1.0 micron from said liquid.

3. A method according to claim 2, additionally comprising adding an effective dosage of soluble floral preservative to said liquid.

4. A method according to claim 3, additionally comprising adding an effective dosage of a soluble algaecide to said liquid.

5. A method according to claim 1 in which the circulating liquid is separately cooled to temperatures of about 32° to 39° F.

6. A method according to claim 1, additionally comprising adding an effective dosage of soluble floral preservative to said liquid.

7. A method according to claim 1, additionally comprising adding an effective dosage of a soluble algaecide to said liquid.

8. In a system for storage and display of fresh cut flowers in a budlike or closed state in a plurality of containers having a liquid reservoir including:

means for discharging a liquid in each of said containers for discharging liquid from the liquid reservoir when the liquid level exceeds a threshold liquid level; and means for circulating liquid among said plurality of containers, the improvement comprising:

means for separately cooling said circulating liquid to temperatures of about 32° to about 50° F., said means for separately cooling being provided in said system to contact the liquid as it circulates among said plurality of containers, thus to maintain blooms of the flowers in the budlike or closed state for a longer period of time.

9. The system according to claim 7 in which said means for circulating liquid is configured for continuously circulating liquid among said plurality of containers.

10. The system according to claim 7 in which said means for circulating liquid is configured for intermittently circulating liquid among said plurality of containers.

11. In a system according to claim 8, the improvement further comprising means for filtering the circulating liquid through a filtration means and removing substantially all particulate material having a particle size in excess of about 1.0 micron, said means for filtering the circulating liquid being connected in said system to receive the liquid as it circulates among said plurality of containers.

12. The system according to claim 11 in which said means for filtering the circulating liquid includes a filter element which will remove substantially all particulate material having a particle size in excess of about 0.45 micron.

13. The system according to claim 8 in which said means for separately cooling has a sufficient cooling capacity to cool said liquid to temperatures of about 32° to 39° F.

14. In a system for storage and display of fresh cut flowers in a budlike or closed state in a plurality of containers having a liquid reservoir including: means for holding said plurality of containers in a vertically stacked relationship forming at least one column;

means for discharging a liquid in each of said containers for discharging liquid from the liquid reservoir when the liquid level exceeds a threshold liquid level;

means for circulating liquid among said plurality of containers;

means for filtering the circulating liquid and removing substantially all particulate material having a particle size in excess of about 1.0 micron, the improvement comprising:

means for separately cooling said circulating liquid to temperatures of about 32° to about 50° F., said means for separately cooling being provided in said system to contact the liquid as it circulates among said plurality of containers, thus to maintain blooms of the flowers in the budlike or closed state for a longer period of time.

15. The system according to claim 14 in which said means for separately cooling has a sufficient cooling capacity to cool said liquid to temperatures of about 32° to 39° F.

16. In a system for storage and display of fresh cut flowers in a budlike or closed state in a plurality of containers having a liquid reservoir, said plurality of containers being arranged in a vertically stacked relationship forming at least one column;

a means for discharging liquid in each of said containers for discharging liquid from the liquid reservoir when the liquid level exceeds a threshold liquid level;

a means for circulating liquid among said plurality of containers; the improvement comprising:

a means for separately cooling said circulating liquid to temperatures of about 32° to about 50° F., said means for separately cooling being provided in said system to contact the liquid as it circulates among said plurality of containers, thus to maintain blooms of the flowers in the budlike or closed state for a longer period of time.

17. The system according to claim 16 in which said means for separately cooling has a sufficient cooling capacity to cool said liquid to temperatures of about 32° to 39° F.

* * * * *